US008813830B2

(12) United States Patent
Priebe et al.

(10) Patent No.: US 8,813,830 B2
(45) Date of Patent: Aug. 26, 2014

(54) USE OF BRANCHED ALKANE DIOL CARBOXYLIC ACID DIESTERS IN POLYURETHANE-BASED FOUNDRY BINDERS

(75) Inventors: Christian Priebe, Wülfrath (DE); Diether Koch, Mettmann (DE)

(73) Assignee: ASK Chemicals GmbH (DE)

( * ) Notice: Subject to any disclaimer, the term of this patent is extended or adjusted under 35 U.S.C. 154(b) by 0 days.

(21) Appl. No.: 12/865,364

(22) PCT Filed: Jan. 30, 2009

(86) PCT No.: PCT/EP2009/000613

§ 371 (c)(1),
(2), (4) Date: Jul. 29, 2010

(87) PCT Pub. No.: WO2009/095251

PCT Pub. Date: Aug. 6, 2009

(65) Prior Publication Data

US 2011/0005702 A1 Jan. 13, 2011

(30) Foreign Application Priority Data

Feb. 1, 2008 (DE) ..... 10 2008 007 181

(51) Int. Cl.
*B22C 1/22* (2006.01)

(52) U.S. Cl.
CPC ..... *B22C 1/2273* (2013.01)
USPC ..... 164/526; 164/16; 164/525; 523/139; 523/142; 523/145

(58) Field of Classification Search
CPC ..... B22C 1/22; B22C 1/2273; B22C 9/123
USPC ..... 523/139, 142, 145
See application file for complete search history.

(56) References Cited

U.S. PATENT DOCUMENTS

| | | | | |
|---|---|---|---|---|
| 3,409,579 | A | 11/1968 | Robins | |
| 3,676,392 | A | 7/1972 | Robins | |
| 4,079,031 | A * | 3/1978 | Sardessai et al. | 523/143 |
| 4,268,425 | A * | 5/1981 | Gardikes | 523/143 |
| 4,311,631 | A * | 1/1982 | Myers et al. | 523/143 |
| 4,540,724 | A | 9/1985 | Dunnavant et al. | |
| 6,136,888 | A * | 10/2000 | Torbus et al. | 523/142 |
| 6,242,388 | B1 * | 6/2001 | Sharma et al. | 507/90 |
| 6,509,392 | B1 * | 1/2003 | Jhaveri et al. | 523/142 |
| 6,772,820 | B2 * | 8/2004 | Roze et al. | 164/16 |
| 2004/0176491 | A1 | 9/2004 | Brown | |
| 2005/0245711 | A1 | 11/2005 | Narayan-Sarathy et al. | |

FOREIGN PATENT DOCUMENTS

| | | | |
|---|---|---|---|
| EP | 0 182 809 | B1 | 3/1991 |
| EP | 0 261 775 | B1 | 6/1992 |
| EP | 0 295 262 | B1 | 9/1994 |
| EP | 0 695 594 | A2 | 2/1996 |
| EP | 0 769 338 | A1 | 4/1997 |
| EP | 0 771 599 | A1 | 5/1997 |
| EP | 1 137 500 | B1 | 3/2004 |
| WO | WO 95/03903 | | 2/1995 |
| WO | WO 98/19809 | | 5/1998 |

OTHER PUBLICATIONS

Eastman Chemical Brochure, published Aug. 2006, 2 pgs.*
PCT Notification of Transmittal of Translation of the International Preliminary Report on Patentability (Chapter I or Chapter II of the Patent Cooperation Treaty) dated Sep. 16, 2010, for corresponding International Application No. PCT/EP2009/000613.
PCT Notification Concerning Availability or the Publication of the International Application dated Sep. 16, 2010 for corresponding International Application No. PCT/EP2009/000613.

* cited by examiner

*Primary Examiner* — Devang R Patel
(74) *Attorney, Agent, or Firm* — Locke Lord LLP; Alan B. Clement; Peter J. Fallon

(57) ABSTRACT

The invention relates to a molding material mixture for production of molded products for the foundry industry, comprising at least one fire-resistant base molding material and a polyurethane-based binder system comprising a polyisocyanate component and a polyol component. According to the invention, the polyurethane-based binder system comprises a portion of a carboxylic acid diester of a branched alkane diol, said portion being at least 3 weight-%, and a portion of aromatic solvent of less than 10 weight-% of the binder system. A preferable carboxylic acid diester is 2,2,4-trimethyl-1,3-pentandiol-diisobutyrate. The molded products produced from the molding material mixture for the foundry industry are characterized by a high strength and a lower generation of fumes and smoke during pouring.

15 Claims, No Drawings

USE OF BRANCHED ALKANE DIOL CARBOXYLIC ACID DIESTERS IN POLYURETHANE-BASED FOUNDRY BINDERS

This application is a national phase entry under 35 USC §371 of International Application Number PCT/EP2009/000613, filed on Jan. 30, 2009, entitled "USE OF BRANCHED ALKANE DIOL CARBOXYLIC ACID DIESTERS IN POLYURETHANE-BASED FOUNDRY BINDERS", of which is herein incorporated by reference.

The invention relates to a moulding material mixture for production of moulded products for the foundry industry, a method for producing a casting mould using the moulding material mixture, a casting mould, and use of the casting mould for metal casting.

Casting moulds for producing metal products are essentially made in two variants. A first group consists of cores and moulds. Together, these make up the casting mould that essentially represents a negative mould of the casting to be produced, wherein cores are used to form cavities in the interior of the casting, and moulds define the outer boundary. The interior cavities are often defined by cores, while the outer contour of the casting is represented by a green sand mould or a permanent steel mould. A second group consists of hollow bodies, also known as risers, which function as equalising reservoirs. These can hold molten metal, and in this case appropriate measures are put in place to ensure that the metal remains in the liquid phase longer than the metal in the casting mould that forms the negative mould. If the metal in the negative mould begins to solidify, molten metal can flow out of the equalisation reservoir to compensate for the volume contraction that occurs when the metal solidifies.

Casting moulds consist of a fire-resistant material, for example quartz sand, the grains of which are bound after demoulding by a suitable binder to lend the casting mould sufficient mechanical strength. Thus, casting moulds are made from a fire-resistant base moulding material mixed with a suitable binder. The moulding material mixture obtained from the base moulding material and the binder is preferably in a flowable form, so that it can be introduced into a suitable hollow mould and compacted therein. The binder creates firm cohesion between the particles of the base moulding material, lending the casting mould the requisite mechanical stability.

Both organic and inorganic binders can be used to produce the casting moulds, and such binders may be cured in hot or cold processes. The term cold processes is used to refer to processes that are performed essentially at room temperature, without heating the moulding material mixture. In this case, curing is usually effected by a chemical reaction, which may be triggered for example when a gas-phase catalyst is passed through the moulding material mixture to be cured, or by mixing a liquid catalyst with the moulding material mixture. In hot processes, the moulding material mixture is heated after the moulding process to a temperature that is high enough to enable the solvent contained in the binder to be driven out, or to initiate a chemical reaction by which the binder is cured by crosslinking.

At the moment, many different types of organic binders are used to produce casting moulds, including for example polyurethane, furan resin or epoxy acrylate binders, and the binder is cured by the addition of a catalyst. Polyurethane-based binders are generally constituted from two components, a first component being a phenolic resin and a second component containing a polyisocyanate. These two components are mixed with base moulding material and the moulding material mixture is introduced into a form by ramming, shooting, or another process, compacted and then cured. Depending on the method by which the catalyst is introduced into the moulding material mixture, a distinction is made between the "polyurethane no-bake method" and the "polyurethane cold box method".

In the no-bake method, a liquid catalyst, generally a liquid tertiary amine, is introduced into the moulding material mixture before the mixture is placed in the mould and cured. To produce the moulding material mixture, phenolic resin, polyisocyanate and a curing catalyst are mixed with the fire-resistant base moulding material. In this context, it is then possible to proceed for example such that the base moulding material is first encased with one component of the binder, and then the second component is added. In this case, the curing catalyst is added to one of the components. The moulding material mixture thus prepared must remain workable for a period long enough to enable the moulding material mixture to be plastically deformed and worked into the form of a moulded product. To this end, polymerisation must take place correspondingly slowly, so that the moulding material mixture is not cured in the storage containers or the feed lines. On the other hand, curing must not take place too slowly either, in order to achieve a sufficient throughput rate for producing casting moulds. The processing time may be influenced for example by adding retarding agents, which slow the rate of curing of the moulding material mixture. A suitable retarding agent is phosphoroxy chloride, for example.

In the cold box method, the moulding material mixture is first introduced into a mould without a catalyst. A gas-phase tertiary amine, which may be mixed with an inert carrier gas, is then passed through the moulding material mixture. Upon contact with the gas-phase catalyst, the binding agent sets very quickly, thus enabling a high throughput rate to be achieved in the production of casting moulds.

U.S. Pat. No. 3,409,579 describes a binding compound that includes a mixture of a resin component, a curing component and a curing agent. The resin component includes a phenolic resin that is obtained by condensation of a phenol and an aldehyde. The phenolic resin is dissolved in an organic solvent. The curing component includes a liquid polyisocyanate that has at least two isocyanate groups. The binder includes a tertiary amine as the curing agent. In order to manufacture moulded products, the phenolic resin component and the polyisocyanate component are mixed with a fire-resistant base moulding material. The moulding material mixture is then introduced into a mould where it is given the shape of a moulded product. To cure the moulding material mixture, which normally takes place at room temperature, the gas-phase curing agent is passed through it. Suitable curing agents are for example trimethyl amine, dimethyl ethylamine, dimethyl isopropyl amine or triethyl amine. The tertiary amine may be warmed so that it vaporises more readily. After curing, the casting mould may be taken out of the moulding tool.

In U.S. Pat. No. 3,676,392, a resin compound is described that includes a phenolic resin component dissolved in organic solvents, a hardening component, and a curing catalyst. A liquid polyisocyanate that includes at least two isocyanate groups is used as the hardening component. The polyisocyanate is used in a quantity of 10 to 15% by weight relative to the weight of the resin. The curing catalyst is a base having a $pK_b$ value in the range from about 7 to about 11, and is used in a quantity of 0.01 to 10% by weight relative to the resin.

EP 0 261 775 B1 describes a binder that includes a polyhydroxy component, an isocyanate component, and a catalyst for the reaction between these components. The polyhydroxy component is dissolved in a liquid ester of an aliphatic alkoxycarboxylic acid. In example 6, a binder is described that contains an aromatic solvent in a proportion of 19% by weight, ethyl-3-ethoxy propionate in a proportion of 15% by weight, "red oil" in a proportion of 1% by weight, and 2,2,4-Trimethyl-1,3-pentanediol-diisobutyrate (TXIB) in a proportion of 5% by weight as the solvent for the resin.

EP 0 695 594 A2 describes a polyurethane-based foundry binder that contains a biphenyl as an additive. In example 1 and in comparison examples 2 and 3, 2% by weight 2,2,4-Trimethyl-1,3-pentanediol-diisobutyrate is added to the binder as a plasticiser. A compound containing 17% by weight aromatic solvent and 10% by weight doubly or triply substituted biphenyl is added as the solvent.

EP 0 766 388 A1 describes a polyurethane-based foundry binder containing an epoxy resin and preferably a paraffin oil. In example 3 and in comparison example 3, a binder system containing 2% by weight 2,2,4-Trimethyl-1,3-pentanediol diisobutyrate as a plasticiser is used. Aromatic hydrocarbons are used as the solvent.

U.S. Pat. No. 4,268,425 describes a binder system for the foundry industry based on multiple polyurethanes. A drying oil is added to the binder system. In example 1, a binder system is described in which the phenolic resin component contains DBE (Dibasic Ester) and $C_6$-$C_{10}$-dialkyl adipate as the solvent. The phenolic resin component contains 2% by weight 2,2,4-Trimethyl-1,3-pentanediol-diisobutyrate as an additional component. The isocyanate component contains 8.8% by weight aromatic solvent and 6.2% by weight petroleum ether as the solvent.

U.S. Pat. No. 4,540,724 describes a polyurethane-based binder system of which the primary component is a phosphorous halide. In example 2, a binder system is described in which the phenolic resin component contains 10% by weight 2,2,4-Trimethyl-1,3-pentanediol-diisobutyrate as well as 27% by weight aromatic solvents. The phenolic resin component also contains linseed oil and/or polymerised linseed oil. The isocyanate component also contains aromatic solvents.

In WO 98/19899, a binder system based on multiple polyurethanes is described, in which the polyisocyanate component has been modified by reaction with an aliphatic alcohol having at least one active hydrogen atom. Aliphatic solvents may be used for the isocyanate component.

In order to be able to apply the polyhydroxy component and the isocyanate component in a thin, even film to the grains of the base moulding material, the components are diluted with solvents. Most frequently, the components are rendered compatible with each other by aromatic solvents, though these may be harmful to health. During pouring, the binder decomposes under effect of the heat of the liquid metal. As a result, fumes and smoke are generated in large quantities during pouring. The waste gases that occur during pouring must therefore be extracted by an expensive ventilation system in order to comply with environmental and occupational health and safety regulations.

The generation of smoke and fumes is largely attributable to the aromatic solvents contained in the binder. Accordingly, attempts have been made to develop alternative solvent systems that contain no aromatic solvents or only a small fraction of such aromatic solvents for foundry binders.

For example, EP 0 771 599 describes a polyurethane-based binder system containing methyl esters of higher fatty acids as the solvent. In this context, rapeseed oil methyl ester is particularly suitable when used alone as the solvent.

EP 1 137 500 B1 describes a polyurethane-based binder system in which the phenolic resin component or the polyisocyanate component includes a fatty acid ester that has been esterified with an alcohol having a high carbon number. In this context, fatty acid butyl esters and fatty acid octyl esters or fatty acid decyl esters are used particularly preferably. The phenolic resin component includes an alkoxy-modified phenolic resin in which less than 25 mol % of the hydroxymethanol groups are etherified by a primary or secondary aliphatic mono-alcohol having 1 to 10 carbon atoms. The fraction of solvent in the phenolic resin component is not greater than 40% by weight.

The generation of fumes and steam during pouring may be reduced significantly by the use of fatty acid esters that have been esterified with longer-chain alcohols. However, efforts are still being made to find alternative methods by which the emissions during pouring may be reduced even further. Two such possible methods are as follows. In the first method, the components of the binder may be modified in such manner that they generate a smaller amount of fumes. In the second method, the binder may be modified such that it has a stronger binding force, that is to say the proportion of the binder in the moulding material mixture may be reduced.

The object of the invention was therefore to provide a moulding material mixture for producing moulded products for the foundry industry that enable moulded products to be produced even though smaller proportions of binder are used, and having sufficient strength to ensure that they are able to be handled safely and without suffering damage even in a technical production process.

This object is solved with a moulding material mixture having the features of claim 1. Advantageous embodiments are the objects of the respective dependent claims.

Surprisingly, it was found that branched alkane diol carboxylic acid diesters demonstrate good tolerance towards both the polyisocyanate component and the polyol component, so that the components of the binder system are able to be dissolved in a relatively small quantity of solvent. In most cases, it is not necessary to add any aromatic solvents to the branched alkane diol carboxylic acid diester, because not only may the solubility of the polyurethane-based binder be increased to such a degree that the quantity of solvent in the binder system may be kept low, but also the viscosity of the binder system or that of its components may be reduced to such an extent that the grains of the fire-resistant base moulding material may be coated evenly with a thin film of the binder after short mixing times. This is very important in the no-bake method, for example, because in this method the liquid catalyst is added to the binder system, and the period for which the moulding mixture material remains workable before the binder cures is relatively short.

The quantity of fumes and smoke generated during pouring is already reduced simply because of the small amount of solvent, which is necessary in order to adjust the viscosity. Additionally, smoke development during pouring may be reduced further if only small quantities or even no aromatic solvents are added. For these purposes, aromatic solvents are understood to include aromatic hydrocarbons such as toluene, xylene, and particularly high boiling-point aromatic hydrocarbons having a boiling point above 150° C. The inventors assume that the branched alkane diol carboxylic acid diesters used in the binder system of the moulding material mixture according to the invention are considerably less prone to generating smoke and fumes than aromatic solvents because of their oxygen content and their non-aromatic nature.

A further advantage of the moulding material mixture according to the invention was found to be that the moulded products produced and cured therefrom have high mechanical stability. In a technical application, this means that the proportion of binder in the moulding material mixture may be reduced, and the moulded product will still retain the desired strength. If a smaller quantity of binder is necessary to obtain adequate mechanical stability of the casting mould, the amount of fumes and smoke generated during pouring may be reduced further.

The object of the invention is therefore a moulding material mixture for producing moulded products for the foundry industry, including at least:

a fire-resistant base moulding material; and a polyurethane-based binder system comprising a polyisocyanate component and a polyol component.

According to the invention, the polyurethane-based binder system includes a branched alkane diol carboxylic acid diester in a proportion of at least 3% by weight and an aromatic solvent in a proportion of less than 10% by weight, relative to the binder system in each case.

It should be noted that many of the components of the moulding material mixture according to the invention are already used in moulding material mixtures for producing moulded products, so the knowledge of one skilled in the art may be invoked on this point.

Thus for example all substances that are known to be fire-resistant and are commonly used in the production of moulded products for the foundry industry may be used here. Examples of suitable fire-resistant base moulding materials are quartz sand, zirconium sand, olivine sand, aluminium silicate sand, chromium sand and mixtures thereof. Quartz sand is used for preference. The fire-resistant base moulding material should have a particle size such that the porosity of the moulded product produced from the moulding material mixture is sufficient to enable volatile compounds to escape during casting. Preferably at least 70% by weight, and particularly at least 80% by weight of the fire-resistant base moulding material has a particle size ≤290 μm. The average particle size of the fire-resistant base moulding material should preferably be between 100 and 350 μm. The particle size may be determined for example by sieve analysis.

The moulding material mixture according to the invention further contains a polyurethane-based binder system, the binder components of which may also be drawn from known binder systems.

Firstly, the binder system contains a polyol component and a polyisocyanate component, and known components may be used in these cases also.

The polyisocyanate component of the binder system may include an aliphatic, cycloaliphatic or aromatic isocyanate. The polyisocyanate preferably contains at least 2 isocyanate groups, preferably 2 to 5 isocyanate groups per molecule. Depending on the desired properties, mixtures of isocyanates may also be used. The isocyanates used may consist of mixtures of monomers, oligomers and polymers, and will therefore be referred to as polyisocyanates in the following.

The polyisocyanate component used may be any polyisocyanate that is commonly used in polyurethane binders for moulding material mixtures in the foundry industry. Suitable polyisocyanates include aliphatic polyisocyanates, for example hexamethylene diisocyanate, alicyclic polyisocyanates, such as 4,4'-Dicyclohexyl methane diisocyanate, and dimethyl derivatives thereof. Examples of suitable aromatic polyisocyanates are toluene-2,4-diisocyanate, toluene-2,6-diisocyanate, 1,5-Naphthalene diisocyanate, xylylene diisocyanate and methyl derivatives thereof, diphenylmethane-4,4'-diisocyanate and polymethylene polyphenyl polyisocyanate.

Although in theory all conventional polyisocyanates react with the phenolic resin to form a crosslinked polymer structure, aromatic polyisocyanates are used preferably, particularly preferably polymethylene polyphenyl polyisocyanate, for example commercially available mixtures of diphenylmethane-4,4'-diisocyanate, its isomers and higher homologues.

The polyisocyanates may be used either in their native form or dissolved in an inert or reactive solvent. A reactive solvent is considered to be a solvent that has a reactive group, such that it is incorporated into the structure of the binder when the binder sets. The polyisocyanates are preferably used in dilute form so that they are better able to coat the grains of the fire-resistant base moulding material with a thin film due to the lower viscosity of the solution.

The polyisocyanates or their solutions in organic solvents are used in concentration strong enough to cause the polyol component to cure, typically in a range from 10 to 500% by weight relative to the weight of the polyol component. Preferably, 20 to 300% by weight relative to the same is used. Liquid polyisocyanates may be used in undiluted form, whereas solid or viscous polyisocyanates are dissolved in organic solvents. Solvents may constitute up to 80% by weight, preferably up to 60% by weight, particularly preferably up to 40% by weight of the isocyanate component.

The polyisocyanate is preferably used in such quantity that the number of isocyanate groups is 80 to 120% of the number of free hydroxyl groups of the polyol component.

In principle, all polyols used in polyurethane binders may be used as the polyol component. The polyol component contains at least 2 hydroxyl groups that are able to react with the isocyanate groups of the polyisocyanate component to enable crosslinking of the binder during curing, thereby lending improved strength to the moulded product when it has cured.

Preferred polyols are phenolic resins that have been obtained by condensing phenols with aldehydes, preferably formaldehyde, in the liquid phase at temperatures up to about 180° C. in the presence of catalytic quantities of metal. The methods for producing such phenolic resins are known.

The polyol component is preferably used as a liquid or dissolved in organic solvents to enable the binder to be spread evenly of the fire-resistant base moulding material.

The polyol component is preferably used in the anhydrous form, because the reaction of the isocyanate component with water is an undesirable secondary reaction. In this context, non-aqueous or anhydrous is understood to mean that the polyol component has a water content preferably less than 5% by weight, particularly preferably less than 2% by weight.

The term "phenolic resin" is understood to mean the reaction product of a reaction between an aldehyde and phenol, phenol derivatives, bisphenols and higher phenol condensation products. The composition of the phenolic resin depends on the specifically selected starter substances, the relative quantities of the starter substances, and the reaction conditions. For example, the catalyst type, the time and the reaction temperature are all important factors, as is the presence of solvents and other substances.

The phenolic resin is typically available as a mixture of various compounds, and may contain addition products, condensation products, unreacted starter compounds such as phenols, bisphenol and/or aldehyde under widely varying conditions.

The term "addition product" is used to refer to reaction products in which at least one hydrogen on a previously unsubstituted phenol or a condensation product is substituted by an organic component. "Condensation product" refers to reaction products that have two or more phenol rings.

Condensation reactions between phenols and aldehydes yield phenolic resins, which are divided into two classes, novolaks and resols, depending on the proportions of the reactants, the reaction conditions, and the catalysts used:

Novolaks are soluble, meltable, non-self-curing, and storage-stable oligomers with a molecular weight in the range from about 500 to 5,000 g/mol. In the condensation reaction between aldehydes and phenols, they are precipitated in a molar ratio of 1:>1 in the presence of acid catalysts. Novolaks are phenol resins without methylol groups, in which the phenyl nuclei are linked via methylene bridges. After hardeners such as formaldehyde, donor agents, preferably hexamethylene tetramine are added, they are able to be hardened with crosslinking at an elevated temperature.

Resols are mixtures of hydroxymethyl phenols that are linked via methylene and methylene ether bridges, and may be obtained by reacting aldehydes and phenols in a molar ratio of 1:<1, optionally in the presence of a catalyst, for example a basic catalyst. They have a molar weight $M_W$<10,000 g/mol.

Phenolic resins that are particularly suitable for use as the polyol component are referred to as "o-o" or "high-ortho" novolaks or benzyl ether resins. They may be obtained by condensation of phenols with aldehydes in a weakly acid medium and using suitable catalysts.

Catalysts that are suitable for producing benzyl ether resins are salts of divalent metal ions such as Mn, Zn, Cd, Mg, Co, Ni, Fe, Pb, Ca and Ba. Zinc acetate is used preferably. The quantity used is not critical. Typical quantities of metal catalyst are 0.02 to 0.3% by weight, preferably 0.02 to 0.15% by weight relative to the total quantity of phenol and aldehyde.

All conventionally use phenols are suitable for use in preparing phenolic resins. Besides unsubstituted phenols, substituted phenols or mixtures thereof may also be used. The phenol compounds are unsubstituted either in both ortho positions or in one ortho position and one para position to enable polymerisation. The remaining ring carbon atoms may be substituted. The choice of substituent is not especially limited, provided the substituent does not interfere with the polymerisation of the phenol or the aldehyde. Examples of substituted phenols are alkyl-substituted phenols, alkoxy-substituted phenols and aryloxy-substituted phenols.

The substituents listed above have for example 1 to 26, preferably 1 to 15 carbon atoms. Examples of suitable phenols are o-cresol, m-cresol, p-cresol, 3,5-xylene, 3,4-xylene, 3,4,5-trimethylphenol, 3-ethylphenol, 3,5-diethylphenol, p-butylphenol, 3,5-dibutylphenol, p-amylphenol, cyclohexylphenol, p-octylphenol, p-nonylphenol, 3,5-dicyclohexylphenol, p-crotylphenol, p-phenylphenol, 3,5-dimethoxyphenol and p-phenoxyphenol.

Phenol itself is particularly preferred. Higher condensed phenols, such as bisphenol A, are also suitable. Polyvalent phenols that have more than one phenolic hydroxyl group are also suitable. Preferred polyvalent phenols have 2 to 4 phenolic hydroxyl groups. Special examples of suitable polyvalent phenols are catechol, resorcinol, hydroquinone, pyrogallol, phloroglucinol, 2,5-dimethylresorcinol, 4,5-dimethylresorcinol, 5-methylresorcinol or 5-ethylresorcinol.

Mixtures of various mono- and polyvalent and/or substituted and/or condensed phenol components may also be used to produce the polyol component.

In one embodiment, phenols having general formula I:

Formula I

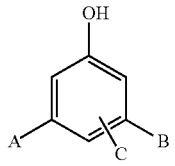

are used to prepare the phenol resin component, wherein A, B and C are independent of each other and are selected from a hydrogen atom, a branched or unbranched alkyl radical having for example 1 to 26, preferably 1 to 15 carbon atoms, a branched or unbranched alkoxy radical having for example 1 to 26, preferably 1 to 15 carbon atoms, a branched or unbranched alkenoxy radical having for example to 26, preferably 1 to 15 carbon atoms, an aryl or alkylaryl radical, such as bisphenyls for example.

Aldehydes suitable for use as the aldehyde for producing the phenolic resin component have the formula:

R—CHO, wherein R is a hydrogen atom or a carbon atom radical preferably having 1 to 8, particularly preferably 1 to 3 carbon atoms. Special examples are formaldehyde, acetaldehyde, propionaldehyde, furfurylaldehyde and benzaldehyde. Particularly preferably, formaldehyde is used, either in its aqueous form, as paraformaldehyde, or as trioxane.

To obtain the phenolic resins, at least an equivalent molar number of aldehyde relative to the molar number of the phenol component should be used. The molar ratio between aldehyde and phenol is preferably 1:1.0 to 2.5:1, particularly preferably 1.1:1 to 2.2:1, especially preferably 1.2:1 to 2.0:1.

The phenolic resin component is produced by methods known to one skilled in the art. In this context, the phenol and the aldehyde are reacted under essentially anhydrous conditions in the presence of a divalent metal ion and at temperatures preferably below 130° C. The water generated thereby is distilled off. For this, a suitable entraining agent, for example toluene or xylene, may be added to the reagent mixture, or distillation is carried out under reduced pressure.

For the binder of the moulding material mixture according to the invention, the phenol component is transformed with an aldehyde, preferably to benzylether resins. It is also possible to transform it to an alkoxy-modified phenolic resin in a single-stage or two-stage process (EP-B-0 177 871 and EP 1 137 500) with a primary or secondary aliphatic alcohol. In the single-stage process, the phenol, the aldehyde and the alcohol are reacted in the presence of a suitable catalyst. IN the two-stage process, first an unmodified resin is prepared, and this is then reacted with an alcohol. If alkoxy-modified phenolic resins are used, in theory there are no limitations with regard to the molar ratio, but the alcohol component is preferably used in a molar ratio alcohol:phenol of less than 0.25, so that less than 25% of the hydroxymethyl groups are etherified. Suitable alcohols are primary and secondary aliphatic alcohols having one hydroxy group and 1 to 10 carbon atoms. Suitable primary and secondary alcohols are for example methanol, ethanol, propanol, n-butanol and n-hexanol. Methanol and n-butanol are particularly preferred.

The phenolic resin is preferably chosen such that crosslinking with the polyisocyanate component is possible. Phenolic resins with molecules that include at least two hydroxyl groups are particularly suitable for crosslinking. The phenolic resin component and the isocyanate component of the binder system is preferably used in solution in an organic solvent or a combination of organic solvents. Solvents may be necessary to ensure that the binder components do not become too viscous. This is necessary for several reasons, and particularly to ensure that the fire-resistant base moulding material is crosslinked uniformly and remains flowable.

According to the invention, the polyurethane-based binder system comprises a portion of a carboxylic acid diester of a branched alkane diol of at least 3% by weight and a portion of aromatic solvent of less than 10% by weight, each with respect to the binder system. In this context, it is possible that only the polyol component or only the polyisocyanate component comprises a portion of the carboxylic acid diester of a branched alkane diol. However, it is also possible that both binder components comprise a portion of a carboxylic acid diester of a branched alkane diol. The polyurethane-based binder system preferably includes a portion of a carboxylic acid diester of a branched alkane diol of more than 5% by weight. According to a further embodiment, the polyurethane-based binder system binder system includes a portion of a carboxylic acid diester of a branched alkane diol of more than 8% by weight. According to a further embodiment, the polyurethane-based binder system binder system includes a portion of a carboxylic acid diester of a branched alkane diol of less than 30% by weight, according to a further embodiment a portion of a carboxylic acid diester of a branched alkane diol of less than 20% by weight. Preferably, at least one of the polyol component and the polyisocyanate component contains at least 3% by weight, particularly at least 5% by weight, particularly preferably at least 8% by weight of a carboxylic acid diester of a branched alkane diol.

The solvent of the respective component may be formed entirely by the carboxylic acid diester of a branched alkane diol. The portion of aromatic solvents is preferably selected to be as small as possible. The portion of the aromatic solvent is less than 10% by weight, preferably less than 5% by weight, particularly preferably less than 3% by weight relative to the binder system. The binder system particularly preferably comprises no aromatic solvents. With reference to the polyol component and the polyisocyanate component, the portion of aromatic solvent contained by at least one of these components is less than 10% by weight, preferably less than 5% by weight, particularly preferably less than 3% by weight.

Other solvents may be used besides the carboxylic acid diester of a branched alkane diol. In principle, such other solvents may be all solvents that are conventionally used in binder systems in foundry applications. Such other suitable solvents include for instance oxygen-rich, polar, organic solvents. Dicarboxylic acid esters, glycol ether esters, glycol diesters, glycol diethers, cyclic ketones, cyclic esters or cyclic carbonates are most suitable. Preferably, dicarboxylic acid esters, cyclic ketones and cyclic carbonates are used. Dicarboxylic acid esters have formula $R^aOOC—R^b—COOR^a$ wherein the radicals $R^a$ are each independent of each other and represent an alkyl having 1 to 12, preferably 1 to 6 carbon atoms, and $R^b$ is an alkylene group, that is to say a divalent alkyl group having 1 to 12, preferably 1 to 6 carbon atoms. $R^b$ may also comprise one or more carbon-carbon double bonds. Examples are dimethyl esters of carboxylic acids having 4 to 10 carbon atoms, which are marketed for example by Invista International S.a.r.l., Geneva, CH, with the designation "dibasic esters" (DBE). Glycol ether esters are compounds having formula $R^c—O—R^d—OOCCR^e$, wherein $R^e$ is an alkyl group having 1 to 4 carbon atoms, $R^d$ is an ethylene group, a propylene group or an oligomeric ethylene oxide or propylene oxide, and $R^e$ is an alkyl group having 1 to 3 carbon atoms. Glycol ether acetates are preferred, for example butyl glycol acetate. Correspondingly, glycol diesters have general formula $R^eCOO—R^dOOCR^e$, wherein $R^d$ and $R^e$ are as defined above, and radicals $R^e$ are each selected independently of each other. Glycol diacetates are preferred, for example propylene glycol diacetate. Glycol diethers may be characterized by the formula $R^c—O—R^d—O—R^c$, wherein $R^c$ and $R^d$ are as defined above, and the radicals $R^c$ are selected independently of each other. A suitable glycol diether is for example dipropylene glycol dimethyl ether. Cyclic ketones, cyclic esters and cyclic carbonates having 4 to 5 carbon atoms are also suitable. A suitable cyclic carbonate is, for example, propylene carbonate. The alkyl and alkylene groups may each be branched or unbranched.

The portion of the solvent in the binder is preferably not too high, since the solvent evaporates during production and use of the moulded product produced from the moulding material mixture, which may result in an unpleasant odour, or the generation of smoke during pouring. The portion of the solvent in the binder system is preferably selected to be less than 50% by weight, particularly preferably less than 40% by weight, especially preferably less than 35% by weight.

The dynamic viscosity of the polyol component and the polyiso-cyanate component, which may be determined for example with the Brookfield rotating spindle method, is preferably less than 1000 mPas, particularly less than 800 mPas, and especially less than 600 mPas.

In principle, any carboxylic acid may be used as the carboxylic acid of a branched alkane diol. The carboxylic acid may include a branched or unbranched alkyl radical. The carboxylic acid may also comprise double carbon-carbon bonds. However, saturated carboxylic acids are preferred. The chain length of the carboxylic acid may be selected within broad limits. Carboxylic acids used preferably comprise 2 to 20 carbon atoms, especially 4 to 18 carbon atoms. A branched carboxylic acid of a branched alkane diol is preferred. Monocarboxylic acids are preferred. However, it is also possible to use semiesters of dicarboxylic acid.

The hydroxy groups of the alkane diol may be arranged in the terminal position as a primary hydroxy group or also within the carbon chain as a secondary or tertiary hydroxyl group. In this context, a secondary hydroxy group is understood to be a hydroxy group bonded to a carbon atom that in turn is bonded to one hydrogen atom and two carbon atoms. Similarly, a tertiary hydroxy group is understood to be a hydroxy group bonded to a carbon atom that in turn is bonded to three other carbon atoms, and a primary hydroxy group is a hydroxy group bonded to a carbon atom that his bonded to one carbon atom and two hydrogen atoms.

The alkane diol preferably comprises one primary and one secondary hydroxy group.

According to a preferred embodiment, the carboxylic diester of a branched alkane diol has a structure as shown in formula I Formula I

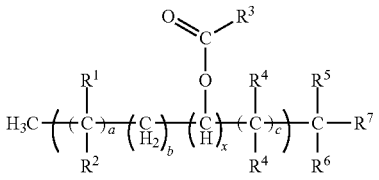

wherein the following characters represent the following, independently of each other and wherever they occur:

$R^1$, $R^7$: H, $CH_3$, $C_2H_5$, $C_3H_7$, $CH_2OC(O)R^3$, $OC(O)R^3$;

$R^2$, $R^4$, $R^5$, $R^6$: H, $CH_3$, $C_2H_5$, $C_3H_7$;

$R^3$: a saturated, unsaturated or aromatic hydrocarbon radical having 1 to 19 hydrocarbon atoms, in which also one or more hydrogen atoms may be replaced by other substituents;

a, b, c: a whole number between 0 and 4;

x 0, 1 or 2; wherein:

at least one of the radicals $R^1$, $R^2$ and $R^4$ is not hydrogen; if $R^1$ and $R^7$ represent $CH_2OC(O)R^3$, $OC(O)R^3$, x=0; and the sum of a+b+c is at least 2.

The carboxylic acid diester of a branched alkane diol preferably has a structure according to formula II:

Formula II

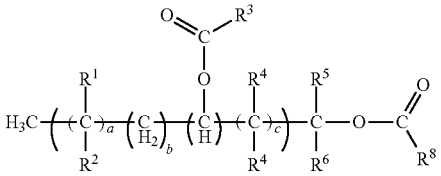

in which $R^2$, $R^3$, $R^4$, $R^5$, $R^6$, a, b, c represent the same is in formula I, and additionally:

$R^1$: H, $CH_3$, $C_2H_5$, $C_3H_7$, wherein $R^1$ is not H, if $R^2=R^4$, $R^5=R^6=H$;

$R^8$: a saturated, unsaturated, or aromatic hydrocarbon radical having 1 to 19 carbon atoms, in which one or more hydrogen atoms may also be replaced by other substituents.

Either $R^1$ or $R^2$ preferably stands for a methyl group or an ethyl group and the other in each case stands for a hydrogen atom radical.

Radicals $R^4$ may be selected independently of each other and preferably include 1 to 3 carbon atoms. The two $R^4$ radicals are preferably the same and particularly preferably represent a methyl group.

According to a further embodiment, $R^5$ and $R^6$ stand for a hydrogen atom.

$R^3$ and $R^8$ may be different groups. $R^3$ and $R^8$ are preferably the same. $R^3$ and $R^8$ may be saturated, unsaturated or aromatic hydrocarbon radicals comprising 1 to 19, preferably 2 to 10, particularly preferably 3 to 6 carbon atoms. One or more hydrogen atoms of the hydrocarbon radical may be replaced by other substituents. Other substituents are generally understood to be atoms or atomic groups that are not hydrogen. Other suitable substituents are halogen atoms, particularly chlorine, a glycidyl radical, and an epoxy group. Preferably, no more than 3 hydrogen atoms of the hydrocarbon radical, particularly no more than 2 hydrogen atoms of the hydrocarbon radical are replaced by other substituents. Particularly preferably, none of the hydrogen atoms in the hydrocarbon radical are replaced by another substituent.

Hydrocarbon radicals $R^3$ and $R^8$ may also be an unsaturated hydrocarbon radical, wherein this includes 1 to 4, preferably 1 to 3, particularly preferably exactly one double bond.

Groups $R^3$ and $R^8$ particularly represent a saturated aliphatic hydrocarbon radical having 1 to 19, preferably 2 to 10, particularly preferably 2 to 5 hydrocarbon atoms. The saturated hydrocarbon radical may be straight-chain or branched, branched hydrocarbon radicals being preferred. $R^3$ and $R^8$ preferably stand for an iso-butyl group.

Indices a, b and c are independent of each other, and each may represent a value 0, 1, 2, 3 or 4, wherein the sum of a+b+c is at least 2. The values of indices a and c are also preferably at least 1 in each case. The sum of a+b+c is preferably less than 10, preferably less than 8.

The alkane diol may present considerable structural variation. Examples of possible alkane diols are presented in the following:

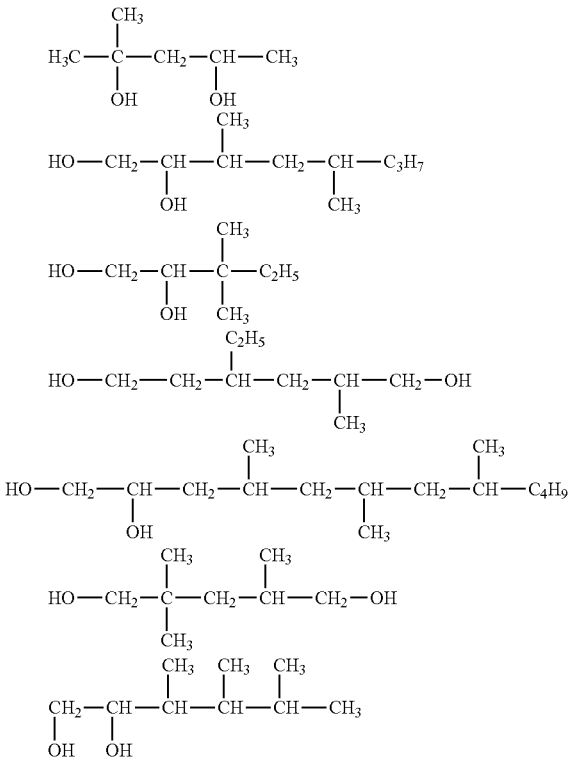

2,2,4-Trimethyl-1,3-pentanediol is particularly preferred as the alkane diol, and isobutyric acid, acetic acid, and benzoic acid are further preferred as the carboxylic acid.

Examples of carboxylic diesters of a branched alkane diol are 2,2,4-Trimethyl-1,3-pentanediol-diacetate and 2,2,4-Trimethyl-1,3-pentanediol-dibenzoate.

In the moulding material mixture according to the invention, 2,2,4-Trimethyl-1,3-pentanediol-diisobutyrate is particularly preferably used as the carboxylic acid diester of a branched alkane diol.

According to a preferred embodiment, the polyurethane-based binder system contains at least a portion of a fatty acid ester as a solvent. Suitable fatty acids preferably contain 8 to 22 carbon atoms, which have been esterified with an aliphatic alcohol. The fatty acids may be present as a homogeneous compound or as a mixture of various fatty acids. Fatty acids of natural origin are preferred, such as tallol, rapeseed oil, sunflower oil, wheatgerm oil and coconut oil. Individual fatty acids such as palmitic acid or oleic acid may be used instead of natural oils and fats. Preferred alcohols are primary alcohols having 1 to 12 carbon atoms, particularly preferably 1 to 10 carbon atoms, especially preferably 4 to 10 carbon atoms, wherein methanol, isopropanol and n-Butanol are particularly preferred. Fatty acid esters of such kind are described for example in EP-A-I 137 500. The "symmetrical esters" described in EP-B-0 295 262, in which the number of carbon atoms is in the same range in both the fatty acid radical and the alcohol radical, preferably 6 to 13 carbon atoms, have also proven suitable.

The portion of the at least one fatty acid ester of the polyurethane-based binder system is preferably selected to be less than 50% by weight, particularly preferably less than 40% by weight, especially preferably less than 35% by weight. According to an embodiment, the portion of the at least one fatty acid ester of the binder system is more than 3% by weight, preferably more than 5% by weight, especially preferably more than 8% by weight.

The proportion of the moulding material mixture that is constituted by the binder system, relative to the weight of the fire-resistant base moulding material, is preferably selected to be between 0.5 and 10% by weight, particularly between 0.6 and 7% by weight.

Besides the components already mentioned, the binder systems may also contain conventional additives, such as silanes (EP-A-I 137 500), or internal releasing agents, such as fatty alcohols (EP-B-0 182 809), drying oils (U.S. Pat. No. 4,268,425) or chelating agents (WO 95/03903), or mixtures thereof.

Suitable silanes are for example aminosilanes, epoxysilanes, mercaptosilanes, hydroxysilanes and ureidosilanes, such as γ-Hydroxypropyl trimethoxysilane, γ-Aminopropyltrimethoxysilane, 3-Ureidopropyltriethoxysilane, γ-Mercaptopropyltrimethoxysilane, γ-Glycidoxypropyltrimethoxysilane, β-(3,4-Epoxycyclohexyl)trimethoxysilane and N-β-(Aminoethyl)-γ-aminopropyltrimethoxysilane.

According to one embodiment, the moulding material mixture according to the invention may comprise a binder system that includes a portion of cashew nutshell oil, at least one component of the cashew nutshell oil, and/or at least a derivative of cashew nutshell oil. When cashew nutshell oil or cashew nutshell oil derivatives are added to the binding agent, it is possible to obtain moulded products for the foundry industry having high thermal stability. A further advantage consists in that the content of monomers still contained in the polyol component, particularly phenol and formaldehyde, is significantly reduced. As a result, smaller quantities of monomers are released during processing, and particularly during pouring, than with the moulding material mixtures according to the prior art.

For the purposes of the invention, the term cashew nutshell oil is understood to refer both to the oil extracted from the seed coats of the cashew tree, which is constituted of approx. 90% anacardic acid and approx. 10% cardol, and processed cashew nutshell oil, which is obtained from the natural product by heat treatment in an acid environment, and the main constituents of which are cardanol and cardol.

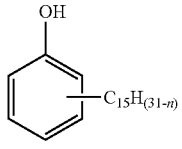

n = 0, 2, 4, 6
Cardanol

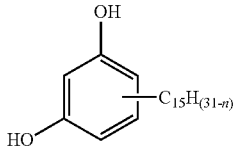

n = 0, 2, 4, 6
Cardol

Substances suitable for use as a component of the binder include the cashew nutshell oil itself, particularly the processes cashew nutshell oil, and also the components obtained therefrom, particularly cardol and cardanol and mixtures and oligomers thereof, such as are left in the collecting receptacle after cashew nutshell oil is distilled. These compounds may also be used in processed quality. The mixture of essentially cardanol and cardol, also referred to as "cashew nutshell liquid (CNSL)" that is obtained when cashew nutshell oil is distilled, is used for preference. The double bonds contained in the side chain of the cardanol and cardol may be transformed partially or completely with hydroxyl groups, epoxy groups, halogens, acid anhydrides, dicyclopentadiene, or hydrogen. In turn, these groups may also be transformed with nucleophils. In polyvalent cashew nutshell oil derivatives, the phenolic OH groups may also be completely or partially derivatised for example by depositing units of ethylene oxide or propylene oxide.

According to the invention, these derivatives of cashew nutshell oil may also be used in the moulding material mixture.

The cashew nutshell oil and the compounds derived therefrom may be contained in the binder as a separate component. These components function as a reactive solvent, which incorporated reactively into the crosslinked polymer as the binder cures. In this embodiment of the moulding material mixture according to the invention, one of the chief characteristics is the high stability of the moulded products at elevated temperatures. For example, test bars that have been produced from a preferred moulding material mixture of such kind demonstrate lower deflection than test bars that have been produced using a binder that is similar in every respect but without the inclusion of cashew nutshell oil.

The at least one component of the cashew nutshell oil and/or the at least one derivative of the cashew nutshell oil constitutes at least a portion of the polyol component. In this embodiment, the at least one cashew nutshell oil component and/or the least one cashew nutshell oil derivative is added while the polyol component is being synthesised, so that it is incorporated in the polyol component during the synthesis. The polyol component is synthesised in known manner, and the at least one cashew nutshell oil component and/or the least one cashew nutshell oil derivative may be added right at the start of the synthesis, or it may be added to the reaction mixture at a later point in the synthesis.

The poly component is particularly preferably formed by condensing a phenolic component and an oxo-component, wherein the cashew nutshell oil, the at least one cashew nutshell oil component and/or the at least one cashew nutshell oil derivative forms at least a part of the phenolic component.

In this context, the polyol component is synthesised in the manner described above for producing the phenolic resin, although in this case the cashew nutshell oil, the at least one cashew nutshell oil component and/or the at least one cashew nutshell oil derivative is added to the phenol component as an additional component. The phenols described previously may be used as the phenolic component, the aldehydes described above may be used as the oxo-component.

The portion of the cashew nutshell oil, the at least one cashew nutshell oil component, and/or the at least one cashew nutshell oil derivative in the phenolic component is preferably 0.5-20% by weight, especially preferably 0.75 to 15% by weight, particularly preferably 1 to 10% by weight.

The cashew nutshell oil, and/or the components or derivatives thereof, may be added to the reaction mixture for synthesis at any time. Addition preferably occurs right at the start of the synthesis.

Cashew nutshell oil, cashew nutshell oil components, and cashew nutshell oil derivatives may also be added to the isocyanate component, wherein they may also react with some of the isocyanate groups.

In order to produce the moulding material mixture, the components of the binder system may first be combined and then added to the fire-resistant base moulding material. However, it is also possible to add the components of the binder to the fire-resistant base moulding material all at once or one after the other. Conventional methods may be used to ensure that the components of the moulding material mixture are mixed evenly. The moulding material mixture may also contain additional components as required, such as iron oxide, ground flax fibres, wood flour granules, pitch, and refractory metals.

A further object the invention relates to a method for producing a casting mould, having the following steps:

Preparing the moulding material mixture described above;

Demoulding the moulding material mixture to produce a casting mould;

Curing the casting mould by adding a curing catalyst.

To produce the casting mould, first the binder is mixed with the fire-resistant base moulding material as described in the preceding to yield a moulding material mixture. If the casting mould is to be produced according to the PU no-bake method, a suitable catalyst may be added to the moulding material mixture at this point. Preferably, liquid amines are added to the moulding material mixture for this purpose. These amines preferably have a $pK_b$ value of 4 to 11. Examples of suitable catalysts are 4-alkyl pyridines, wherein the alkyl group comprises 1 to 4 carbon atoms, isoquinoline, aryl pyridines such as phenyl pyridine, pyridine, acryline, 2-methoxy pyridine, pyridazine, 3-chloropyridine, quinoline, n-Methyl imidazol, 4,4'-Dipyridine, phenyl propylpyridine, 1-Methyl benzimidazol, 1,4-Thiazine, N,N-Dimethylbenzylamine, triethylamine, tribenzylamine, N,N-Dimethyl-1,3-propanediamine, N,N-Dimethylethanol amine, and triethanol amine. The catalyst may be diluted as required with an inert solvent, for example 2,2,4-Trimethyl-1,3-pentanediol diisobutyrate, or a fatty acid ester. The quantity of catalyst added is selected in the range from 0.1 to 15% by weight relative to the weight of the polyol component.

The moulding material mixture is then introduced into a mould by the usual means, and there it is compacted. The moulding material mixture is then cured to form a casting mould. The casting mould should preferably retain its outer mould during curing.

According to a further preferred embodiment, curing is carried out according to the PU cold box method. For this, a gas-phase catalyst is passed through the moulded moulding material mixture. The catalysts may be the substances usually used as catalysts in the cold box method. Amines are particularly preferably used as catalysts, particularly preferably dimethylethyl amine, dimethyl-n-propylamine, dimethylisopropyl amine, dimethyl-n-butylamine, triethyl amine and trimethyl amine, either in the gas phase or as aerosols.

The casting mould produced by this method may have any shape usually used in foundry operations. In a preferred embodiment, the casting mould has the form of foundry moulds or cores.

The invention further relates to a casting mould such as may be obtained by the method described in the preceding. Such a casting mould is characterized by high mechanical stability and low smoke generation during metal pouring.

The invention further relates to a use of this casting mould for casting metals, particularly cast iron and cast aluminium.

The invention will be explained in greater detail in the following with reference to preferred embodiments thereof.

EXAMPLE 1

Synthesis of the Phenolic Resin 1770.6 g phenol, 984.3 g paraformaldehyde (91%), 1.5 g zinc acetate dihydrate and 279.6 g n-Butanol were added to a reaction vessel equipped with a reflux condenser, a thermometer, and a stirrer. The temperature of the mixture was increased to 105 to 150° C. while stirring, and this temperature was maintained until a refractive index (25° C.) of about 1.5590 was obtained. Then, the condenser was replaced with a distillation column and the temperature was increased to 124 to 126° C. within an hour. Distillation was carried out at this temperature until a refractive index (25° C.) of about 1.5940 was obtained. Distillation was then continued under reduced pressure, until the mixture has a refractive index (25° C.) of about 1.6000. The yield is 78%.

EXAMPLE 2

Production of Binders

Polyol Component (Binder Component 1):

The polyol components listed in table 1 were produced with the phenolic resin obtained in example 1.

TABLE 1

Composition of polyol components (binder component 1) (% by weight)

| | Not according to the invention | | | | | According to the invention | | | | | |
|---|---|---|---|---|---|---|---|---|---|---|---|
| | A1 | A2 | A3 | A4 | A5 | A6 | A7 | A8 | A9 | A10 | A11 |
| Phenol resin | 67.5 | 67.5 | 67.5 | 67.5 | 67.5 | 67.5 | 67.5 | 67.5 | 67.5 | 67.5 | 67.5 |
| Rapeseed oil fatty acid methyl ester | 32 | | | | | | 16 | | | | |
| Isopropyl laureate | | 32 | | | | | | 16 | | | |
| 2-Ethylhexyl-2-ethylhexanoate | | | 32 | | | | | | 16 | | |
| Tetraethyl orthosilicate | | | | 32 | | | | | | 16 | |
| DBE | | | | | 32 | | | | | | 16 |
| 2,2,4-Trimethyl-1,3,-pentanediol diisobutyrate | | | | | | 32 | 16 | 16 | 16 | 16 | 16 |
| Silane | 0.5 | 0.5 | 0.5 | 0.5 | 0.5 | 0.5 | 0.5 | 0.5 | 0.5 | 0.5 | 0.5 |

Isocyanate Component (Binder Component 2):

The polyisocyanate components listed in table 2 were produced from polymeric processed 4,4'-MDI.

TABLE 2

| Composition of the polyisocyanate component (binder component 2) (% by weight) | | | | | | | | | | | |
|---|---|---|---|---|---|---|---|---|---|---|---|
| | Not according to the invention | | | | | According to the invention | | | | | |
| | B1 | B2 | B3 | B4 | B5 | B6 | B7 | B8 | B9 | B10 | B11 |
| Polymeric processed 4,4'-MDI | 80 | 80 | 80 | 80 | 80 | 80 | 80 | 80 | 80 | 80 | 80 |
| Rapeseed oil fatty acid methyl ester | 20 | | | | | | 10 | | | | |
| Isopropyl laureate | | 20 | | | | | | 10 | | | |
| 2-Ethylhexyl-2-ethylhexanoate | | | 20 | | | | | | 10 | | |
| Tetraethyl orthosilicate | | | | 20 | | | | | | 10 | |
| DBE | | | | | 20 | | | | | | 10 |
| 2,2,4-Trimethyl-1,3,-pentanediol diisobutyrate | | | | | | 20 | 10 | 10 | 10 | 10 | 10 |

EXAMPLE 3

Production of Test Products 0.8 parts by weight of the phenolic resin solutions indicated in table 1 and of the polyisocyanate component indicated in table 2 are added one after the other in each case to 100 parts by weight of H32 quartz sand (Quarzwerke Frechen) and mixed intensively in a laboratory mixer (Vogel and Schemmann A G, Hahn, D E). After mixing the mixture for 2 minutes, the moulding material mixtures were transferred to the storage hopper of a core shooter (Roperwerke, Gießereimaschinen GmbH, Viersen, Del.) and introduced into the moulding tool by compressed air (4 bar). The moulded products were then cured by gasifying with 1 ml triethyl amine (2 sec, 2 bar pressure, followed by 10 sec. flushing with air).

Test bars with dimensions of 220 mm×22.36 mm×22.36 mm, also known as Georg-Fischer test bars were produced to serve as the test products.

In order to determine bending strengths, the test bars were placed in a Georg Fischer strength tester equipped with a 3-point bending device (DISA-Industrie AG, Schaffhausen, CH), and the force required to bend the test bars to their breaking point was measured.

Bending strengths were measured according to the following schedule:

immediately after their production after storing for 2 hours at room temperature after storing for 24 hours in 98% relative humidity.

The resistance of the test products to water-based coatings was also tested. For this, the test bars were immersed in a water-based coating Miratec® DC 3 (ASK-Chemicals GmbH, Hilden, Del.) for 3 s 10 minutes after they were produced, and then stored at room temperature for 30 min. Some of the test bars coated with the water-based coating were subjected to the strength test after storage for 30 minutes at room temperature. The others were dried at 150° C. for 30 minutes after the 30 minutes' storage at room temperature. After cooling to room temperature, the strength of these test bars was also tested.

The results of the strength test are summarised in table 3.

TABLE 3

| Strength tests | | | | | | | | | | | |
|---|---|---|---|---|---|---|---|---|---|---|---|
| | Not according to the invention | | | | According to the invention | | | | | | |
| | Component 1 | | | | | | | | | | |
| | A1 | A2 | A3 | A4 | A5 | A6 | A7 | A8 | A9 | A10 | A11 |
| | Component 2 | | | | | | | | | | |
| | B1 | B2 | B3 | B4 | B5 | B6 | B7 | B8 | B9 | B10 | B11 |
| Strengths in $N/cm^3$ | | | | | | | | | | | |
| Immediately | 145 | 110 | 115 | 150 | 110 | 175 | 180 | 200 | 175 | 160 | 135 |
| After 24 hours | 460 | 415 | 410 | 440 | 440 | 490 | 500 | 495 | 470 | 455 | 440 |
| 24 hours at 98% rel. humidity | 300 | 310 | 315 | 305 | 215 | 335 | 350 | 365 | 345 | 315 | 245 |
| Water-based coating (Wet value) | 320 | 295 | 310 | 315 | 270 | 325 | 325 | 330 | 320 | 310 | 295 |
| Water-based coating (Dried) | 470 | 455 | 455 | 480 | 480 | 510 | 535 | 530 | 525 | 500 | 490 |

Test bars that had been produced using a binder system containing 2,2,4-Trimethyl-1,3-pentanediol diisobutyrate demonstrate greater strength. Greater strengths are obtained when just 2,2,4-Trimethyl-1,3-pentanediol diisobutyrate is used as the solvent. However, high strengths are also obtained when the solvent contains fatty acid esters having a medium polarity, or also esters having strong polarity and dibasic esters or tetraethyl orthosilicate.

EXAMPLE 4

Effect of the 2,2,4-Trimethyl-1,3-pentanediol diisobutyrate portion in the solvent The effect of other solvents was tested using the example of isopropyl laureate, which was used in various proportions in addition to 2,2,4-Trimethyl-1,3-pentanediol diisobutyrate. The composition of the polyol component for producing the test bars is summarised in table 4. The composition of the polyisocyanate component is summarised in table 5.

TABLE 4

| Composition of the polyol component (% by weight) | | | | | |
|---|---|---|---|---|---|
| | A2 | A12 | A8 | A13 | A6 |
| Phenolic resin | 67.5 | 67.5 | 67.5 | 67.5 | 67.5 |
| Isopropyl laureate | 32 | 22.4 | 16 | 9.6 | |
| 2,2,4-Trimethyl-1,3,-pentanediol diisobutyrate | | 9.6 | 16 | 22.4 | 32 |
| Silane | 0.5 | 0.5 | 0.5 | 0.5 | 0.5 |

TABLE 5

| Composition of the polyisocyanate component (% by weight) | | | | | |
|---|---|---|---|---|---|
| | B2 | B12 | B8 | B13 | B6 |
| Polymeric processed 4,4'-MDI | 80 | 80 | 80 | 80 | 80 |
| Isopropyl laureate | 20 | 14 | 10 | 6 | |
| 2,2,4-Trimethyl-1,3,-pentanediol diisobutyrate | | 6 | 10 | 14 | 20 |

Strength Test:

Test bars were produced in similar manner to example 3, and their strength was tested. The results are summarised in table 6.

TABLE 6

| Strength tests using mixed solvents | | | | | |
|---|---|---|---|---|---|
| | Component 1 | | | | |
| | A2 | A12 | A8 | A13 | A6 |
| | Component 2 | | | | |
| | B2 | B12 | B8 | B13 | B6 |
| Strengths in N/cm$^3$ | | | | | |
| Immediately | 110 | 190 | 200 | 200 | 175 |
| After 24 hours | 415 | 450 | 495 | 485 | 490 |
| 24 hours at 98% rel. humidity | 310 | 360 | 365 | 340 | 335 |
| Water-based coating (Wet value) | 295 | 310 | 330 | 335 | 325 |
| Water-based coating (Dried) | 455 | 500 | 530 | 490 | 510 |

Results:

Even a small proportion of 2,2,4-Trimethyl-1,3-pentanediol diisobutyrate added to the fatty acid ester results in an increase in the strength of the test bars.

EXAMPLE 5

Use of 2,2,4-Trimethyl-1,3-Pentanediol Diisobutyrate in a Mixture with Solvents of Various Polarities Georg Fischer test bar were produced in similar manner to example 1. The composition of the polyol component is shown in table 7, and the composition of the polyisocyanate component is shown in table 8.

TABLE 7

| Composition of the polyol component (% by weight) | | | | | | |
|---|---|---|---|---|---|---|
| | A14 | A15 | A16 | A17 | A18 | A19 |
| Phenolic resin | 67.5 | 67.5 | 67.5 | 67.5 | 67.5 | 67.5 |
| Isopropyl laureate | 19.8 | 11 | 2.2 | 19.8 | 11 | 2.2 |
| DBE | 10 | 10 | 10 | | | |
| Tetraethyl orthosilicate | | | | 10 | 10 | 10 |
| 2,2,4-Trimethyl-1,3,-pentanediol diisobutyrate | 2.2 | 11 | 19.8 | 2.2 | 11 | 19.8 |
| Silane | 0.5 | 0.5 | 0.5 | 0.5 | 0.5 | 0.5 |

TABLE 8

| Composition of the Polyisocyanate component (% by weight) | | | | | | |
|---|---|---|---|---|---|---|
| | B14 | B15 | B16 | B17 | B18 | B19 |
| Phenolic resin | 80 | 80 | 80 | 80 | 80 | 80 |
| Isopropyl laureate | 9 | 5 | 1 | 9 | 5 | 1 |
| DBE | 10 | 10 | 10 | | | |
| Tetraethyl orthosilicate | | | | 10 | 10 | 10 |
| 2,2,4-Trimethyl-1,3,-pentanediol diisobutyrate | 1 | 5 | 9 | 1 | 5 | 9 |

Strength Test:

The strength of the test bars was determined in similar manner to example 3. The results of the strength test are summarised in table 9.

TABLE 9

| Strength test | | | | | | |
|---|---|---|---|---|---|---|
| | Component 1 | | | | | |
| | A14 | A15 | A16 | A17 | A18 | A19 |
| | Component 2 | | | | | |
| | B14 | B15 | B16 | B17 | B18 | B19 |
| Strengths in N/cm$^3$ | | | | | | |
| Immediately | 210 | 190 | 195 | 170 | 200 | 210 |
| After 24 hours | 490 | 495 | 485 | 485 | 480 | 495 |
| 24 hours at 98% rel. humidity | 340 | 330 | 345 | 300 | 305 | 305 |
| Water-based coating (Wet value) | 305 | 295 | 305 | 260 | 275 | 275 |
| Water-based coating (Dried) | 510 | 520 | 520 | 475 | 470 | 455 |

Result:

An increase in the strength of the test bars is also observed if fatty acid esters and strongly polar solvents are used as well as 2,2,4-Trimethyl-1,3-pentanediol diisobutyrate in the binder system.

EXAMPLE 6

Investigation of Smoke Generation

Test bars were produced with the binders indicated in table in similar manner to example 3. The test bars were stored in the furnace for 1 min. at 650° C. After the test bars were removed, smoke generation was determined against a dark background and evaluated subjectively with scores from 10 (very heavy) to 1 (hardly perceptible). The result is summarised in table 10.

TABLE 10

| Evaluation of smoke generation | | | | |
|---|---|---|---|---|
| Component 1 | A2 | A8 | A6 | A15 |
| Component 2 | B2 | B8 | B6 | B15 |
| Evaluation | 10 | 8 | 5 | 4 |

Smoke generation may be reduced by the use of 2,2,4-Trimethyl-1,3-pentanediol diisobutyrate.

The invention claimed is:

1. A moulding material mixture for the production of casting moulds for the foundry industry, including at least:

a fire-resistant base moulding material; and a polyurethane-based binder system comprising a polyisocyanate component and a polyol component, wherein the polyurethane-based binder system comprises a carboxylic acid diester of a branched alkane diol in a proportion of greater than 8% by weight and an aromatic solvent in a proportion of less than 3% by weight, relative to the binder system in each case.

2. The moulding material mixture according to claim 1, wherein the carboxylic acid diester of a branched alkane diol has a structure of the formula

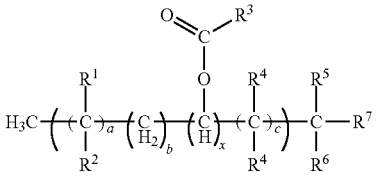

and, each independent from each other and wherever they occur mean:

$R^1$, $R^7$: H, $CH_3$, $C_2H_5$, $C_3H_7$, $CH_2OC(O)R^3$, $OC(O)R^3$; $R^2$, $R^4$, $R^5$, $R^6$: H, $CH_3$, $C_2H_5$, $C_3H_7$; $R^3$: a saturated, unsaturated or aromatic hydrocarbon radical having 1 to 19 hydrocarbon atoms, in which also one or more hydrogen atoms may be replaced by other substituents; a, 1", c: an integer between 0 and 4; x 0, 1 or 2; and, at least one of the radicals $R^1$, $R^2$ and $R^4$ is not hydrogen; if $R^1$ and $R^7$ represent $CH_2OC(O)R^3$, $OC(O)R^3$, x=0; and the sum of a+b+c is at least 2.

3. The moulding material mixture according to claim 1, wherein the branched carboxylic acid diester of a branched alkane diol is 2,2,4-Trimethyl-1,3-pentanediol diisobutyrate.

4. The moulding material mixture according to claim 1, wherein the polyurethane-based binder system comprises at least one fatty acid ester.

5. The moulding material mixture according to claim 4, wherein the portion of the at least one fatty acid ester in the polyurethane-based binder system is selected to be less than 90% by weight.

6. The moulding material mixture according to claim 4 wherein the fatty acid ester is a methyl ester, a butyl ester and/or an isopropyl ester.

7. The moulding material mixture according to claim 1, wherein the polyol component is formed by condensing a phenolic component and an oxo-component.

8. The moulding material mixture according to claim 7, wherein the oxo-component is formed by an aldehyde.

9. The moulding material mixture according to claim 1, wherein the polyol component is formed by a benzyl ether resin.

10. The moulding material mixture according to claim 1, wherein the isocyanate component is an aliphatic, aromatic or heterocyclic isocyanate having at least two isocyanate groups per molecule, or oligomers or polymers thereof.

11. The moulding material mixture according to claim 1, wherein the binder system is present in a proportion of 0.5 to 10% by weight relative to the weight of the fire-resistant base moulding material.

12. A method for producing a casting mould for the foundry industry, said method comprising the following steps:

providing a moulding material mixture as described in claim 1;

forming the moulding material mixture to produce a casting mould; and curing the casting mould by adding a curing catalyst.

13. The method according to claim 12, wherein the curing catalyst is added in gaseous form.

14. The method according to claim 12, wherein the curing is carried out essentially at room temperature.

15. A casting mould for the foundry industry, comprising a moulding material mixture of claim 1.

* * * * *

UNITED STATES PATENT AND TRADEMARK OFFICE

CERTIFICATE OF CORRECTION

PATENT NO. : 8,813,830 B2
APPLICATION NO. : 12/865364
DATED : August 26, 2014
INVENTOR(S) : Christian Priebe et al.

It is certified that error appears in the above-identified patent and that said Letters Patent is hereby corrected as shown below:

In the Claims

In Claim 1, column 21, line 30, after “weight” insert -- ; --.

In Claim 2, column 22, line 2, after “a,” delete “1'''” and insert -- b --.

In Claim 2, column 22, line 3, after “x” insert -- : --.

In Claim 6, column 22, line 17, after “4” insert -- , --.

Signed and Sealed this
Twenty-seventh Day of January, 2015

Michelle K. Lee

Michelle K. Lee
*Deputy Director of the United States Patent and Trademark Office*